US007507891B2

(12) United States Patent
Lau et al.

(10) Patent No.: US 7,507,891 B2
(45) Date of Patent: Mar. 24, 2009

(54) FIBER BRAGG GRATING TUNER

(75) Inventors: Kin Tak Lau, Kowloon (HK); Pou Man Lam, Kowloon (HK)

(73) Assignee: The Hong Kong Polytechnic University, Kowloon (HK)

( * ) Notice: Subject to any disclaimer, the term of this patent is extended or adjusted under 35 U.S.C. 154(b) by 7 days.

(21) Appl. No.: 11/723,555

(22) Filed: Mar. 21, 2007

(65) Prior Publication Data

US 2008/0229905 A1 Sep. 25, 2008

(51) Int. Cl.
*G10G 7/02* (2006.01)

(52) U.S. Cl. ..... 84/454; 84/723; 385/7; 385/10

(58) Field of Classification Search ..... 84/454, 84/723; 385/7, 10
See application file for complete search history.

(56) References Cited

U.S. PATENT DOCUMENTS 3,733,953 A * 5/1973 Ferber ..... 84/724
4,004,482 A 1/1977 Yates
4,086,484 A * 4/1978 Steensma ..... 398/200
4,235,113 A * 11/1980 Carome ..... 73/655
4,238,856 A * 12/1980 Bucaro et al. ..... 398/134
4,294,513 A * 10/1981 Nelson et al. ..... 385/4
4,297,887 A * 11/1981 Bucaro ..... 73/655
4,321,463 A * 3/1982 Stecher ..... 250/227.19
4,442,750 A * 4/1984 Bowley ..... 84/724
4,563,931 A * 1/1986 Siebeneiker et al. ..... 84/724
4,688,460 A * 8/1987 McCoy ..... 84/724
4,715,671 A * 12/1987 Miesak ..... 398/141
4,815,353 A * 3/1989 Christian ..... 84/724
5,012,086 A * 4/1991 Barnard ..... 250/222.1
5,214,232 A * 5/1993 Iijima et al. ..... 84/724
5,381,492 A * 1/1995 Dooley et al. ..... 385/12
5,410,404 A * 4/1995 Kersey et al. ..... 356/478
5,684,592 A * 11/1997 Mitchell et al. ..... 356/493
5,848,204 A * 12/1998 Wanser ..... 385/12
5,892,582 A * 4/1999 Bao et al. ..... 356/519
6,201,912 B1 * 3/2001 Kempen et al. ..... 385/37
6,274,801 B1 * 8/2001 Wardley ..... 84/731
6,411,748 B1 * 6/2002 Foltzer ..... 385/7
6,797,872 B1 9/2004 Catalano et al.
6,984,819 B2 * 1/2006 Ogawa ..... 250/227.21
7,002,672 B2 2/2006 Tsuda
7,015,390 B1 * 3/2006 Rogers ..... 84/723
7,027,136 B2 4/2006 Tsai et al.
7,084,341 B2 * 8/2006 Barr ..... 84/743
7,122,783 B1 * 10/2006 Pastore et al. ..... 250/227.14
7,129,468 B2 * 10/2006 Ennes ..... 250/221
7,262,834 B2 * 8/2007 Kageyama et al. ..... 356/28
7,336,862 B1 * 2/2008 Xai et al. ..... 385/12
2008/0229905 A1 * 9/2008 Lau et al. ..... 84/454

* cited by examiner

*Primary Examiner*—Walter Benson
*Assistant Examiner*—Robert W Horn
(74) *Attorney, Agent, or Firm*—Kauth, Pomeroy, Peck & Bailey LLP

(57) ABSTRACT

The present invention relates an instrument tuner possessing a fiber optic with a prewritten fiber Bragg grating. The tuner is suitable for providing more accurate instrument tuning, capable of not being subject to a tuner's subjectivity or distortions or electromagnetic interference.

18 Claims, 3 Drawing Sheets

| Pitch of note | Standard frequency (Hz) | Measured frequency (Hz) |
|---|---|---|
| A2 (5th string) | 110.0 | 110.0 |
| D3 (4th string) | 146.8 | 143.5 |
| G3 (3rd string) | 196.0 | 195.4 |
| B3 (2nd string) | 246.9 | 247.2 |
| C4 | 261.6 | 263.7 |
| E4 (2st string) | 329.6 | 327.3 |
| A4 | 440.0 | 440.5 |

FIG. 5(b)

FIBER BRAGG GRATING TUNER

BACKGROUND

Stringed musical instruments are typically tuned through the use of an electronic tuner which is capable of detecting the frequency of vibration generated by plucking, striking, or stroking a single string on the instrument and communicating any difference between the frequency of the generated vibration and a standard frequency on a standard musical scale. Prior to electronic tuners, tuning forks were used as standards. In this method, a tuner selects a tuning fork known to be the same pitch as the standard for one of the open stings of the instruments and strikes it. The fork is then placed on some solid surface. The tuner then strikes the open string of the instrument to be tuned, discerning by use of the ear any discrepancy between the pitches of the two notes thus sounded.

However, the problem with current tuning methods as well as well-known methods includes the subjective skill of a tuner to discern differences in two notes (for tuning forks) and background noise, distortion, or electromagnetic interference which can affect electronic tuners.

Methods for detecting a strain change using a fiber Bragg grating (FBG) sensor has been taught in the prior art. Such methods have focused on FBG used for determining structural examination of the soundness of mechanical constructions such as automobiles, aircraft, bridges, buildings, etc., but have never been applied to or suggested to be used for instruments.

It is an object of the present system to overcome the issues and problems in the prior art.

DESCRIPTION

The present system proposes a music tuner specifically for use by stringed instruments, such tuner possessing a fiber optic with a prewritten fiber Bragg grating.

The present system further proposes means for providing more accurate instrument tuning by utilizing a tuner having a fiber optic with a prewritten fiber grating, the tuner being connected to a light source and a detector.

The present system proposes the music tuner of the present invention in order to provide a tuning apparatus that is not subject to a tuner's ear subjectively when comparing two notes, nor subject to distortions or electromagnetic interference.

These and other features, aspects, and advantages of the apparatus and methods of the present invention will become better understood from the following description, appended claims, and accompanying drawings where:

The following description of certain exemplary embodiments) is merely exemplary in nature and is in no way intended to limit the invention, its application, or uses. Throughout this description, the term "fiber Bragg grating" refers to a reflector constructed in a short segment of optical fiber that reflects particular wavelengths of light and transmits all others.

Figure 1:
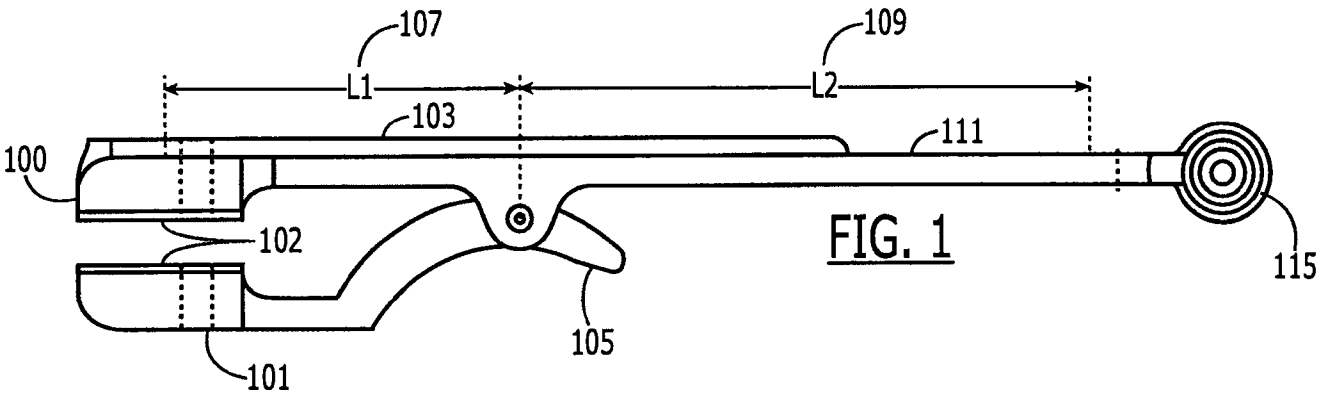
FIG. 1 shows an instrument tuning apparatus in accordance with the present invention.

Now, to FIGS. 1-5,

FIG. 1 shows an apparatus 100 in accordance with the present invention, including a holding means 101, an actuation device 105 for the holding means 105, 101, a reinforcing rib 103, a first amplification section L1 107, a second amplification section L2 109, an embedded fiber optic 111, and a head connector 115.

As will be discussed later, the apparatus 100 is useful for tuning an instrument, in particular a stringed instrument. The holding means 101 is useful for securely contacting the instrument, preferably on its body where vibration of the string is transmitted to the sound board of the instrument. The holding means 101 can be, for example, a clamp. The contacting portions 102 of the holding means 101 can be coated with a polymer having a low coefficient of friction. Such a polymer allows the contact portions 102 of the holding means 101 to engage the instrument while not scratching the instrument. Further, the polymer allows for small surface area contact. This allows avoidance of faulty readings brought about by damping. Examples of suitable polymers for the contact portions 102 include fluoropolymers such as fluourinated ethylene propylene (FEP), perfluoroalkoxy polymer resin (PFA), and polytetrafluoroethylene (Teflon™).

The holding means 101 is controlled by an actuating device 105. The actuating device 105 can be actuated by a finger, i.e., when pressing the device 105 toward the apparatus 100 body, the mouth of the holding means 101 opens. When depressed, the mouth of the holding means 101 closes. The actuating device 105 can be closed-oriented, i.e., in its rest position, the actuating device 105 allows the holding means 101 to be closed. In its inner workings, the actuating device 105 can include locking means such as screws, springs, nuts and bolts, and the like.

In one embodiment, the holding means 101 and actuating device 105 operates as a C-clamp. In this embodiment, the actuating device 105 can be a screw type whereby when the screw is screwed-closed, the mouth of holding means 101 will close. When unscrewed, the vice versa occurs. In this embodiment, the mouth can usually be opened larger to make allowance for larger instrument bodies.

The apparatus 100 includes a reinforcing rib 103. The reinforcing rib 103 can be a polymer type material, with sufficient stiffness to disallow the apparatus 100 from bending when in use. The reinforcing rib 103 can extend from the front of the apparatus 100 to beyond the middle.

The apparatus 100 includes at least two stages for calculating amplification of a signal, L1 107 and L2 109. Amplification is calculated by the following:

$$\text{Signal amplification} = \frac{L2}{L1}$$

The amplification is used to boost the signal derived from the instrument as it is transmitted through the embedded fiber optic. In one embodiment, L1 107 stage stretches from near the front of the apparatus 100 to about the actuating device 105. L2 109 stage begins at the point where L1 107 ends, and continues to about the back of the apparatus 100.

As will be discussed later, an optical fiber written with Bragg grating 111 is embedded within the apparatus 100.

At the end of the apparatus 100, a fiber head controller 115 is inserted. The fiber head controller 115 is used for supplying a light signal to the fiber optic and delivering a signal to be measured by a detector.

Figure 2:
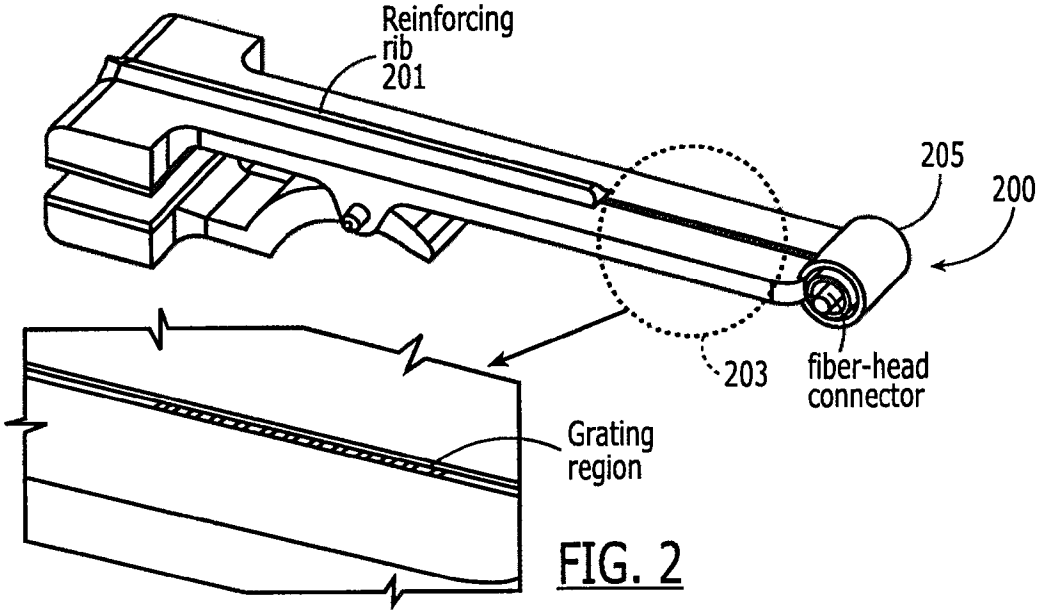
FIG. 2 shows a bird's eye view of the instrument tuning apparatus.

FIG. 2 shows a bird's eye view of an apparatus 200 of the present invention. Through the bird's eye view, the reinforcing rib 201, the grating region 203, and the fiber-head connector 205 can be seen.

As shown, the reinforcing rib 201 extends from the front of the apparatus to beyond the actuating device of the holding means. As stated, the reinforcing rib 201 acts to stop the apparatus from bending when in use.

The grating region 203 of the fiber optic is preferably a fiber Bragg grating (FBG). When the apparatus 200 is in use, the grating region 203 is subjected to geometric property changes. These geometric property changes take the form of alterations in tension (stretching) and compression of the grating region 203. The Bragg wavelength changes in response to the geometric property changes. The frequency change, as will be discussed later, is then measured. The measured frequency is compared to a standard frequency of the particular note, and a determination is made if the musical instrument is well-tuned. The number of grates on the fiber optic can be made by well-known methods, for example $CO_2$-laser. The number of grates can range from 1-∞. As will be discussed later, the fiber is embedded within the apparatus.

The fiber head connector 205 is connected to a light source and detector via a coupler. Through the connector 205, a light signal is provided to the grating region 203 of the fiber optic. As the grating region undergoes geometric changes (tensing and compressing), a reflected light signal, possessing characteristics of the geometric changes, is sent to and captured by the detector. The connector 205 can be standard equipment used in the industry, and can include parts such as ferrule, springs, crimping rings, housing, and boots. Examples of suitable connectors include but are not limited to SMA, STC, biconic, face-end, paint contact, D3, D4, epoxyless, SC, FDDI, E2000, DIN, ESCON, and MT.

Figure 3:
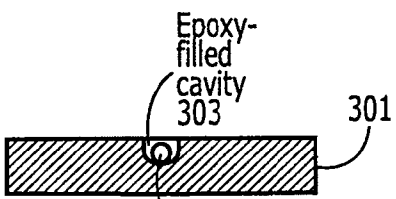
FIG. 3 shows the embedded fiber optic in the apparatus, such embedded fiber optic surrounded by epoxy-filled cavity.

FIG. 3 shows the embedding of the fiber optic 305 in the epoxy-filled cavity 303 of the apparatus 301.

The fiber optic 305 may be embedded a few microns below the surface of the apparatus 301. In general, the fiber optic 305 is embedded from about the reinforcing rib of the apparatus 301 to the fiber head connector of the apparatus 301. The width of the cavity 303 can range from a few microns beyond the diameter of the fiber optic 305.

The epoxy used to fill the cavity 303 is, generally, an epoxy resin formulation suitable for electronic systems. The epoxy resin can be of the general formula;

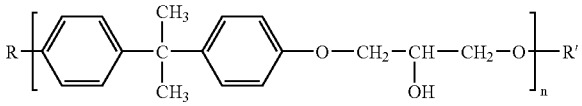

where R and $R^1$ can include group such as methyl, ethyl, polymethyl, cyclic compounds, ether, polyether, combinations of such, and the like, and where "n" can range, generally, from 1 to 25.

Figure 4:
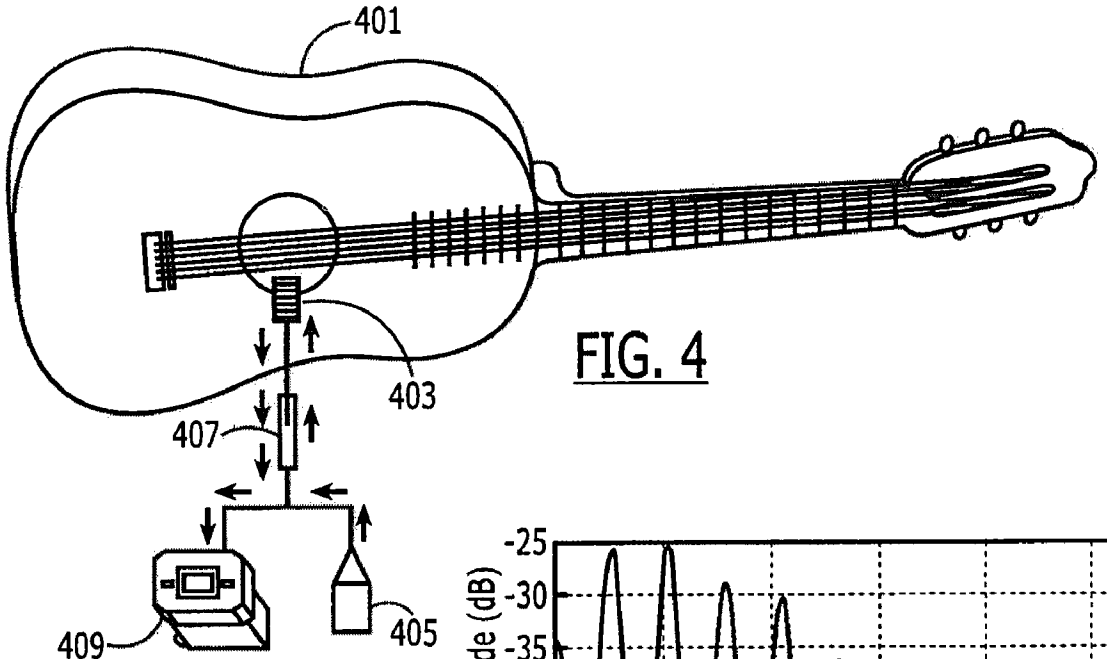
FIG. 4 shows the apparatus connected to an instrument, and a light source and detector.

FIG. 4 is an embodiment in accordance with the present invention, wherein a fiber Bragg grating music tuner 403 is connected, through a coupler 407, a light source 405 and a detector 409. The tuner 403 is connected to a musical instrument 401 when tuning the instrument 401.

The tuner 403 is preferably applied to stringed instruments, such as an Ajaeng, Anzad, Arpeggione, Banhu, Baryton, Bazantar, Bowed psaltery, Cello, Electric cello, Cizhonghu, Crwth, Dahu, Đn gáo, Diyingehu, Double bass, Erhu, Erxian, Esraj, Fiddle, Gadulka, Gaohu, Gehu, Guaychak, Goje, Gudok, Gusle, haegeum, Hardanger fiddle, Huluhu, Huqin, Igil, Jinghu, Kemenche, Knose, Kokyu, Laruan, Leiqin, Lirone, Mahuhu, Masenqo, Morin khuur, Nyckelharpa, Octobass Paslmodikon, Rebec, Sarangi, sarinda, Saw sam sai, Sihu, Tro, Trumpet marine, Vielle, Viol, Lyra viol, Violone, Division viol, Viola bastarda, Viola, Viola d'amore, Viola pomposa, Violin, Electic violin, Kit violin (Dancing master violin), Stroh violin, Violin octet instruments, Vertical viola, Violotta, Yayli tanbur, Yazheng, Yehu, Zhonghu, Zhuihu, appalachian dulcimer, Autoharp, Bağama, Bajo sexto, Balalaika, Bandura, Bandurria, Banjo, Barbat, Begena, Bordonua, Bouzouki, Bugarija, Cavaquinho, Çeng, Charango, Chitarra battente, Bhitarrone, Cittem, Cuatro, Cümbüş, Đn bầu, Đn nguyệt, Đn tranh, Đn tỳbà, Daruan, Diddley bow, Dombra, Domra, Doshpuluur, Dutar, Duxianqin, Ektara, Electric bass, Electric vprihgt bass, Gayageum, Geomungo, Gottuvakhyam, Gravikord, Guitar, Bass guitar, Acoustic bass guitar, Cigar box guitar, Electric guitar, Baritone guitar, Tenor guitar, Harp guitar, Resonator guitar, Guitarrón, Gusli, Guqin, Guzheng, Harp, Electric harp, Harpsichord, Irish bouzouki, Kacapi, Kantele, Kanun, Kobza, Konghou, Kontigi, Kora, Koto, Krar, Kytiyapi, Langleik, Laud, Liuqin, Lute, Archlute, Theorbo, Lyre, Madolin, Mandola, Octave mandola, Mandocello, Mando-banjo, Mohan veena, Monochord, Musical bow, Nyatiti, Oud, Pandura, Pipa, Portuguese guitar, Psaltery, Qanún/kanun, Qinqin, Requinto, Rote, Rubab, Rudra veena, Sallaneh, Sanxian, Saraswati veena, Sargija, Sarod, Saung, Saz, Shamisen, Sitar, Tambura, Tamburitza, Tanbur, Tar, Tea chest bass, Tiple, Torban, Tres, Tricordia, Ukulele, Valiha, Veena, Vichitra veena, Vihuela, Paul Panhuysen's string installations, Yueqin, Zhongruan, Zhu, Zither, Berimbau, Cimbalom, Chapman stick, Chitarra battente, Clavichord, Đn tam thập lục, Hammered dulcimer, Khim Piano, Santoor, Santur, Warr guitar, Yanggeum, Yangqin. In one embodiment, the tuner 403 is used for violins, violas, bass, and guitars.

The tuner 403 is preferably adjustable, allowing its mouth to be opened at various sizes to accommodate instruments of different thickness. The tuner 403 is preferably positioned adjacent to the position where the vibration of the string is transmitted to the sound board of the instrument. In the case of a guitar, the tuner would be placed on the hole on the sound board. As stated earlier, the contact surface between the tuner 403 and the instrument 401 is minimized to reduce a damping effect when a note is played. Further, a coating is applied to the mouth of the tuner 403 so that it does not scratch or damage the instrument 401.

The tuner 403 is attached to a coupler 407. The coupler 407 as used herein is suitable for carrying the optical signal from the source 405 to the tuner with fiber Bragg grating and then to the detector 409. Suitable couplers include passive couplers, and tee couplers. The coupler can be fused biconical tapered, wavelength selective or active coupler. To the connector is attached an input light source 405 and a detector 409. The input light source 405 can generally be standard equipment used in the industry, such as light emitting diodes (LED) or injection laser diodes (ILD). The transmission may be analog or digital. The light source 405 can include circuitry such as preprocessors, drive circuits, monitors, temperature monitors, and coolers. The light source 405 further possesses an interface for engaging the fiber optic.

The fiber optic from the source 405 is diverted to the coupler. From the coupler, a fiber optic is further directed to a detector 409. The detector 409 is used for converting the optic signal resulting from the tuner 403 into an electrical signal. As previously stated, the light source 405 delivers an optical signal through the coupler to the tuner 403. An optical signal is then diverted to the detector 409. The light ray transmitted through the tuner with fiber Bragg grating and the light ray reflected from the grating are opposite each other in phase in response to the strain to which the grating subjected to, and that a signal that is obtained by summing the transmitted light ray and reflected light ray changes in response to a change in strain. When the tuner 403 is in use, i.e., reading a note played on the instrument 401, the electrical signal provides information on the frequency of the note played. The measured frequency is then compared to a standard frequency for the note for tuning purposes. The detector is preferably a photodetector. The detector 409 can be an analog or digital receiver, and can include components such as preamplifiers, amplifiers, demodulators, filters, and comparators.

In an alternative embodiment, the detector 409 may be connected, through wired or wireless means, to a computer system, for storing electrical signals or comparing electrical signals against standards. Such a computer system can include a display, user interface devices such as keyboard, temporary storage such as RAM, permanent storage such as ROM, microprocessor, and operational algorithms.

EXAMPLE

A fiber grated tuner was connected to a guitar that was previously tuned with a KORG™ GA-30 electronic tuner. The frequencies of 5 strings and two other notes, C4 and A4, were measured with the tuner.

Figure 5A:
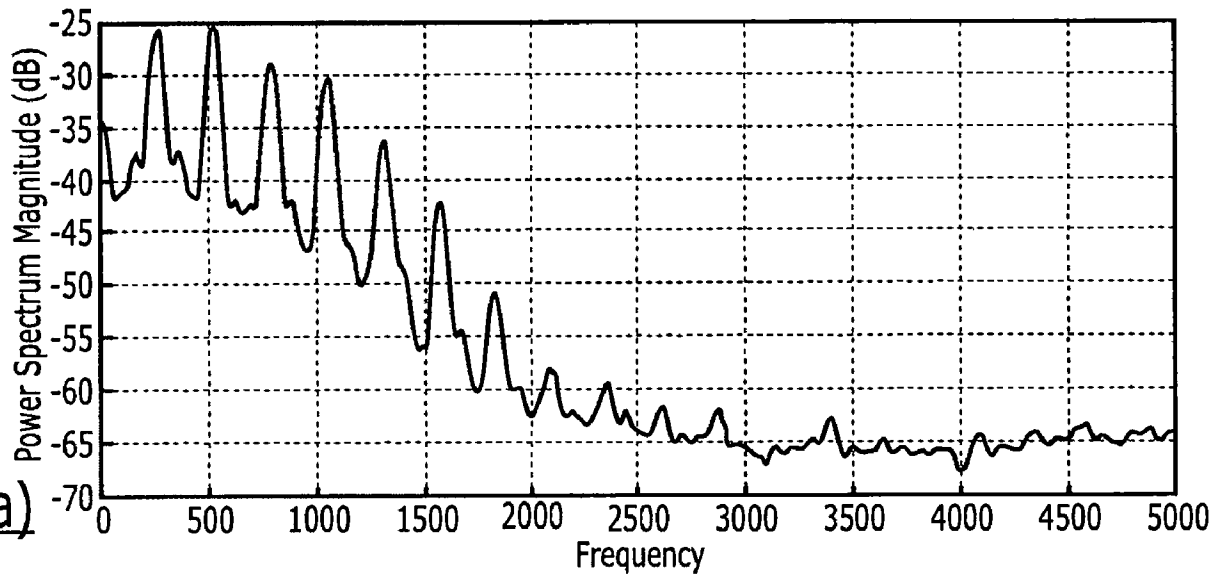
FIG. 5 shows the results of an example of utilizing the apparatus to tune an instrument.

FIG. 5(*a*) shows the data collected from the testing. The results are summarized at FIG. 5(*b*). As shown, the data collected represents the actual pitch frequency obtained by using the electronic tuner, which is not so accurate when compared to the standard frequency.

Whereas there are discrepancies between the standard frequency and the measured frequency, it is believed the discrepancies are caused by technical error during the tuning process as opposed to tuner error or distortion.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

The invention claimed is:

1. An apparatus for tuning a stringed musical instrument, the apparatus comprising:

a fiber Bragg grating (FBG) recorded within a core of an optical fiber; and a holding member connected to the optical fiber and removably connected to the instrument in which vibration of a string of the instrument is transmitted to the optical fiber through the holding member;

wherein the transmitted vibration causes light reflected by the FBG to alter, the altered reflected light is converted into a frequency that is compared to a predetermined frequency of a musical note to determine whether the musical instrument is well-tuned.

2. The apparatus of claim 1, wherein the holding member is a clamp.

3. The apparatus of claim 2, wherein a mouth of said clamp is coated with a polymer having a low coefficient of friction and a low damping factor.

4. The apparatus of claim 3, wherein said polymer is selected from any one from the group consisting of: fluourinated ethylene propylene, perfluoroalkoxy polymer resin, and polytetrafluoroethylene.

5. The apparatus of claim 3, wherein the mouth is adjustable between spaced and proximate positions.

6. The apparatus of claim 2, wherein the holding member further comprises a reinforcing rib to prevent the apparatus from bending when in use, the reinforcing rib extends from an end proximate the mouth of holding member to about a central portion of the the holding member.

7. The apparatus of claim 1, wherein said stringed instrument is any one from the group consisting of: violin, viola, bass and guitar.

8. The apparatus of claim 1, wherein the optical fiber is embedded in a cavity of the holding member with an epoxy resin.

9. The apparatus of claim 2, wherein the head connector is any one from the group consisting of: SMA, STC, biconic, face-end, paint contact, D3, D4, epoxyless, SC, FDDI, E200, DIN, ESCON and MT.

10. The apparatus according to claim 1, further comprising a head connector connected to one end of the holding member distal from a instrument contacting end of the holding member; a coupler connected to the head connector and a light source and a detector, wherein light transmitted by the light source transmits through the optical fiber connected to the holding member.

11. The apparatus according to claim 1, wherein the holding member further comprises a reinforcing rib to prevent the holding member from bending when in use.

12. The apparatus according to claim 5, wherein the holding member further comprises an actuating member on an end opposite the mouth of the holding member, the actuating member movable to vary spaced and proximate positions of the mouth.

13. The apparatus according to claim 1 further comprising a detector, coupled to the optical fiber, converting the altered reflected light into an electrical signal to derive the frequency of the musical note that is compared to the predetermined frequency of the predetermined musical note to determine whether the musical instrument is well-tuned.

14. A system for tuning a stringed musical instrument, the system comprising a fiber Bragg grating (FBG) recorded within a core of an optical fiber;

a holding member connected to the optical fiber to secure the optical fiber to the instrument such that vibration of a string of the instrument is transmitted to the optical fiber;

a light source to transmit light through the FBG via the optical fiber; and wherein vibration of a string is transmitted to the optical fiber via the holding member causing a Bragg wavelength of the FBG to alter, and the alteration is converted into an electrical signal by a light detector to derive a frequency of a musical note that is compared to a predetermined frequency of a predetermined musical note to determine whether the musical instrument is well-tuned.

15. The system of claim 14, wherein said light source is a light emitting diode or an injection laser diode.

16. The system of claim 14, wherein the light detector is a photodetector.

17. A method for tuning a stringed musical instrument, the method comprising:

vibrating a string of the instrument;

wherein vibration of the string is transmitted to an optical fiber causing a Bragg wavelength of a fiber Bragg grating (FBG) recorded within a core of the optical fiber to alter, and the alteration is converted into an electrical signal to derive a frequency of a musical note that is compared to a predetermined frequency of a predetermined musical note to determine whether the musical instrument is well-tuned.

18. A method for tuning a stringed musical instrument, the method comprising:

removably connecting an optical fiber to the stringed musical instrument in a non-contacting relationship with any portion of the instrument;

providing light through an optical fiber having a fiber Bragg grating;

transmitting vibration of a string to the optical fiber, the provided light being altered by the transmitted vibration of the string;

converting an electrical signal based on the altered light;

deriving a frequency of a musical note based on the electrical signal; and comparing the derived frequency of the musical note to a predetermined musical note frequency; and determining whether the musical instrument is well-tuned based on the compared frequencies.

* * * * *